United States Patent [19]

Sakai et al.

[11] 4,243,420

[45] Jan. 6, 1981

[54] PARTICULATE MATERIAL FOR FORMING MOLDS AND METHOD FOR PRODUCING SAME

[75] Inventors: Junji Sakai, Minommachi; Syogo Morimoto, Matsudo; Takashi Shimaguchi, Minorimachi, all of Japan

[73] Assignee: Hitachi, Ltd., Japan

[21] Appl. No.: 30,924

[22] Filed: Apr. 17, 1979

[30] Foreign Application Priority Data

Apr. 17, 1978 [JP] Japan ..... 53-44259

[51] Int. Cl.[3] ..... B23B 7/34

[52] U.S. Cl. ..... 106/38.3; 106/38.35; 106/38.9; 164/15

[58] Field of Search ..... 106/38.3, 38.35, 38.9; 164/15

[56] References Cited

U.S. PATENT DOCUMENTS

| | | | |
|---|---|---|---|
| 3,436,235 | 4/1969 | Baer et al. | 106/38.35 |
| 3,778,493 | 12/1973 | Shaw | 106/38.3 |
| 3,870,529 | 3/1975 | Okumoto et al. | 106/38.3 |

*Primary Examiner*—Lorenzo B. Hayes

*Attorney, Agent, or Firm*—Craig & Antonelli

[57] ABSTRACT

Particulate material for forming molds produced by mixing particulate refractory material with one material selected from the group consisting of colloidal silica, colloidal alumina, colloidal zirconia and ethyl silicate, drying the mixture and allowing same to set, and crushing the dried mixture into particulate form again. The particulate material includes refractory particles provided with a coat of silica or alumina or zirconia on the surface and increases the strength and surface precision of a mold.

4 Claims, No Drawings

PARTICULATE MATERIAL FOR FORMING MOLDS AND METHOD FOR PRODUCING SAME

BACKGROUND OF THE INVENTION

This invention relates to particulate material for forming molds, particularly those which are suitable for producing precision castings, and a method for producing such particulate material.

In one type of method for forming molds known in the art, water is added in suitable amount to ethyl silicate to form a solution, to which particulate refractory material and a gelation promoting agent are added to prepare a refractory slurry. The slurry is charged around a pattern of soluble material to form a mold. After gelation, the mold is immersed in water to completely harden the mold and at the same time to allow the pattern to melt out of the mold. Finally, the mold is dried and fired.

When components of particulate material differ from one another in specific gravity, refractory particles of high specific gravity will sink in a mass of slurry, with a result that the completed mold will have different charging rates at different portions. In such case, the strength and dimensional accuracy of the mold will be adversely affected.

When a mold is assembled, machining is necessary in some cases. When this is the case, the use of refractory particles of coarse grain size will cause a reduction in surface precision of the mold due to the coarse grains appearing on the surface of the mold.

OBJECT OF THE INVENTION

This invention obviates the aforesaid disadvantages of the prior art. The invention has as its object the provision of particulate material for forming molds and a method for producing same, which is capable of increasing the strength and surface precision of the mold.

SUMMARY OF THE INVENTION

Particulate material for forming molds comrising refractory particles provided with a coat of silica or alumina on the surface. The particulate material is suitable for use in forming a mold by a process in which water is added in suitable amount to ethyl silicate to form a solution, to which particulate refractory material and a gelation promoting agent are added to prepare a refractory slurry which is charged around a pattern of soluble material to form a mold. After gelation, the mold is immersed in hardening liquid to completely harden it and at the same time to allow the pattern to melt out of the mold. The mold is then dried and fired.

The particulate material for forming molds is produced by mixing particulate refractory material with one of the materials of the group consisting of colloidal silica, colloidal alumina, colloidal zirconia and ethyl silicate, drying the mixture and allowing it to set, and crushing the dried mixture into particulate form again.

EMBODIMENTS OF THE INVENTION

In this invention, ethyl silicate [$Si(OC_2H_5)_4$] is a solution of silica ($SiO_2$) in ethyl alcohol ($C_2H_5OH$) in which they are chemically bonded to each other. Colloidal alumina is a dispersion of alumina ($Al_2O_3$) in water, and colloidal silica is a dispersion of silica in water or alcohol.

When the solution and dispersions mentioned above are dried and fired, silica and alumina again appear to stabilize the thermal resistance of the particulate material for forming molds and increase the bond of the particulate material in a mold.

Silica, alumina, zirconia, graphite or fused silica may be used as particulate refractory material.

The pattern of soluble material may be formed of any material as desired. One or two materials may be used either singly or in the form of a mixture by selecting them from the group consisting of urea, nitrates, polyvinyl alcohol, polyvinyl pyrrolidone, melamine, sodium hydroxycarboxylate, sorbitol and cellulose derivatives, which are suitable materials.

Preferred embodiments of the invention will now be described. First, examples for producing the particulate material in accordance with the invention will be described.

EXAMPLE 1

To 1 kg of the particles (270 mesh) of fused silica were added 400 cc of a hydrolytic solution of ethyl silicate (containing $SiO_2$ in 20%) and 8 cc of an aqueous solution of ammonium carbonate as a hardener. The mixture was kneaded and allowed to set. The hardened mixture was crushed by means of a crusher into particles of 5–200 mesh. The particulate material obtained was used for forming a mold.

EXAMPLE 2

To 3 kg of zirconia flour (325 mesh) was added 900 cc of colloidal silica (containing $SiO_2$ in 30%), and the mixture was agitated, dried and allowed to set. The hardened mixture was crushed by means of a crusher into particles of 20–200 mesh. The particulate material obtained was used for forming a mold.

EXAMPLE 3

To 500 gr of artificial graphite (200 mesh) was added 100 cc of colloidal alumina (containing $Al_2O_3$ in 10%), and the mixture was agitated, dried and allowed to set. In adding alumina, about 50 cc was initially added and then the rest was added after the mixture was dried. The reason why the colloidal alumina was added in two parts is because it will take a long time to dry if 100 cc is given in one part, since colloidal alumina has a high water content (90%). The hardened mixture was crushed by means of a crusher into particles of 20–200 mesh. The particulate material obtained was used for forming a mold.

One example of forming a mold by using the particulate material produced by the examples described above will be described.

Particles (270 mesh) of fused silica and the particulate material produced by the method described by referring to Example 1 were mixed with each other at a ratio 7:3 to provide a mix.

A binder including the following components (in volume percent) was used:

Ethyl silicate (containing $SiO_2$ in 40%): 85.0%

1.5% ethyl alcohol: 6.5%

Water: 8.5%

The binder prepared as described above in which hydrolysis of ethyl silicate was allowed to take place was added to the mix in 30% with respect to the latter, and the mix was thoroughly kneaded with a kneading machine. Then, an aqueous solution of ammonium carbonate (containing ammonium carbonate in 10%) was added as a hardener in 2% with respect to the binder, and the mix was thoroughly kneaded again in the same manner as described above to provide a mold forming mix in slurry form.

The mold forming mix in slurry form was poured in a metal mold formed of aluminum. After being poured, the slurry began to harden in several minutes. When hardening of the slurry had progressed half-way, the formed mold in semi-hardened state was removed from the metal mold and immersed in water. Immersing in water quickly hardened the mold. The hardened mold was dried and fired to provide a completed mold.

The strength of the mold formed as described above will be compared with that of a mold (control) formed by a conventional method.

Test pieces were bars of 25.4×25.4×200 mm which were dried at 200° C., heated at 900° C. for one hour and cooled. The test pieces treated in this way were tested for deflective strength by applying a concentrated load to the center of each test piece supported at two points spaced apart from each other a distance of 50 mm. The value of the load which had brought about breakage of the test piece represented the deflective force of the test piece.

The specimen used as a control was of the same size as the test pieces and prepared by a conventional method so that refractory particles had no coat thereon.

The following table shows the results of tests.

| | Comparison of the Invention with the Prior art in deflective force | |
|---|---|---|
| | Refractory Particles | Deflective Force ($Kg/cm^2$) |
| This Invention-1 | Fused Silica | 41.7 |
| This Invention-2 | Zirconia Flour | 57.2 |
| This Invention-2 | Artifical Graphite | 35.8 |
| Control | Zirconia and Fused Silica | 32.5 |

From this table, it will be appreciated that the molds formed of the mold forming particulate material according to the invention have very high strength.

The particulate material for forming a mold according to the invention comprises refractory particles which are so fine that they pass 200 mesh or more. This feature makes the particulate material suitable for use in forming a mold for producing castings of thin sections and precision castings wherein highly smooth surface finishes are required.

The particulate material according to the invention can also be used in the investment casting or 'lost wax' process.

The present invention can achieve the following effects:

(1) The mold formed of the particulate material according to the invention has high strength, and this property enables the particulate material to be used for producing thin-section and complex, precision castings.

(2) The castings produced by the mold formed of the particulate material according to the invention have high surface finishes.

What is claimed is:

1. A method for producing a precision casting mold comprising the steps of:

mixing refractory material in particulate form with a coating material selected from the group consisting of colloidal silica, colloidal alumina, colloidal zirconia and ethyl silicate to form a mix;

further adding an aqueous solution of ammonium carbonate to the mix when the coating material is ethyl silicate;

drying said mix and allowing the dried mix to set;

crushing the mix to form a particulate composition;

admixing the resultant particulate composition with a binder comprising an aqueous solution of hydrolysed ethyl silicate and with a hardening and gelling agent to form a slurry;

forming the slurry into a mold having a desired shape and allowing the mold to gel; and immersing the gelled mold in a hardening liquid to allow the mold to completely harden and thereafter drying and firing the mold.

2. A method for forming a mold according to claim 1, wherein said particulate composition is produced by mixing 400 cc of a hydrolytic solution of ethyl silicate, 1 kg of particles of fused silica and 8 cc of an aqueous solution of ammonium carbonate, by kneading the mixture and allowing the mixture to set, and finally by crushing the set mixture into particles of 5–20 mesh.

3. A method for forming a mold according to claim 1, wherein said particulate composition is produced by mixing 900 cc of colloidal silica and 3 kg of zirconia powder, by kneading the mixture and allowing the mixture to set and by finally crushing the set mixture into particles of 20–200 mesh.

4. A method for forming a mold according to claim 1, wherein said particulate composition is produced by mixing 100 cc of colloidal alumina and 500 grams of artificial graphite, by kneading the mixture and allowing the mixture to set, and by finally crushing the set mixture into particles of 20–200 mesh.

* * * * *